US011441765B2

(12) United States Patent
Opsomer

(10) Patent No.: US 11,441,765 B2
(45) Date of Patent: Sep. 13, 2022

(54) LED WALL ASSEMBLY WITH RECONFIGURABLE SUPPORTS

(71) Applicant: Production Resource Group, LLC, New Windsor, NY (US)

(72) Inventor: Frederic Opsomer, Kortemark (BE)

(73) Assignee: Production Resource Group, LLC, New Windsor, NY (US)

( * ) Notice: Subject to any disclaimer, the term of this patent is extended or adjusted under 35 U.S.C. 154(b) by 0 days.

(21) Appl. No.: 16/596,202

(22) Filed: Oct. 8, 2019

(65) Prior Publication Data

US 2020/0109846 A1 Apr. 9, 2020

Related U.S. Application Data

(60) Provisional application No. 62/742,850, filed on Oct. 8, 2018.

(51) Int. Cl.

| | |
|---|---|
| ***F21V 23/06*** | (2006.01) |
| ***H01R 33/945*** | (2006.01) |
| ***H01R 33/94*** | (2006.01) |
| ***F21Y 115/10*** | (2016.01) |
| ***F21V 21/092*** | (2006.01) |
| *F21S 2/00* | (2016.01) |
| *F21S 4/15* | (2016.01) |
| *F21V 21/32* | (2006.01) |

(52) U.S. Cl.

CPC ..... *F21V 23/06* (2013.01); *F21V 21/092* (2013.01); *H01R 33/94* (2013.01); *H01R 33/945* (2013.01); *F21S 2/005* (2013.01); *F21S 4/15* (2016.01); *F21V 21/32* (2013.01); *F21Y 2115/10* (2016.08)

(58) Field of Classification Search

CPC ..... F21V 21/08; F21V 21/088; F21V 21/092; F21V 21/096; F21V 21/32; F21V 23/06; F21S 2/005; F21S 4/15; H01R 33/945

See application file for complete search history.

(56) References Cited

U.S. PATENT DOCUMENTS

| | | | | |
|---|---|---|---|---|
| 4,719,549 | A * | 1/1988 | Apel | F21V 21/08 362/398 |
| 7,255,624 | B2 * | 8/2007 | Daftari | A63H 33/046 446/485 |
| 7,322,873 | B2 * | 1/2008 | Rosen | A63H 33/042 446/124 |
| 2009/0015361 | A1 * | 1/2009 | Tremblay | A63H 33/046 335/285 |
| 2010/0197148 | A1 * | 8/2010 | Rudisill | H01R 13/2407 439/40 |
| 2016/0146445 | A1 * | 5/2016 | Shine | F21V 21/096 362/234 |

* cited by examiner

*Primary Examiner* — Alexander K Garlen

(74) *Attorney, Agent, or Firm* — Law Office of Scott C Harris, Inc

(57) ABSTRACT

A device between connect device for connecting between multiple modular LED structures includes a node, which connects to a modular LED wall, at one end and has the other end which receives power and/or video. In between the first and second ends have a spherical surface. A node linking structure has suction cups that connected the spherical surface and allow changing angles between the different node so that the LED modular devices can have different angles in between them.

6 Claims, 2 Drawing Sheets

LED WALL ASSEMBLY WITH RECONFIGURABLE SUPPORTS

BACKGROUND

A "space frame" is a device formed of a number of different LED panels which each can be separately controlled and powered, and independently configured, e.g., to point in different directions.

Each panel of the space frame is a rectangular LED panel that, once connected, is modular in the sense that it is separately controlled from all other panels.

SUMMARY

The present application describes a system and method for connecting to and holding, in a flexible way, multiple different modular LED panels.

BRIEF DESCRIPTION OF THE DRAWINGS these and other aspects will be described with reference to the accompanying drawings, in which.

DETAILED DESCRIPTION

The invention can include any or all of LED tiles, with nodes driving the tiles, and node linking structures between the tiles.

Figure 1:
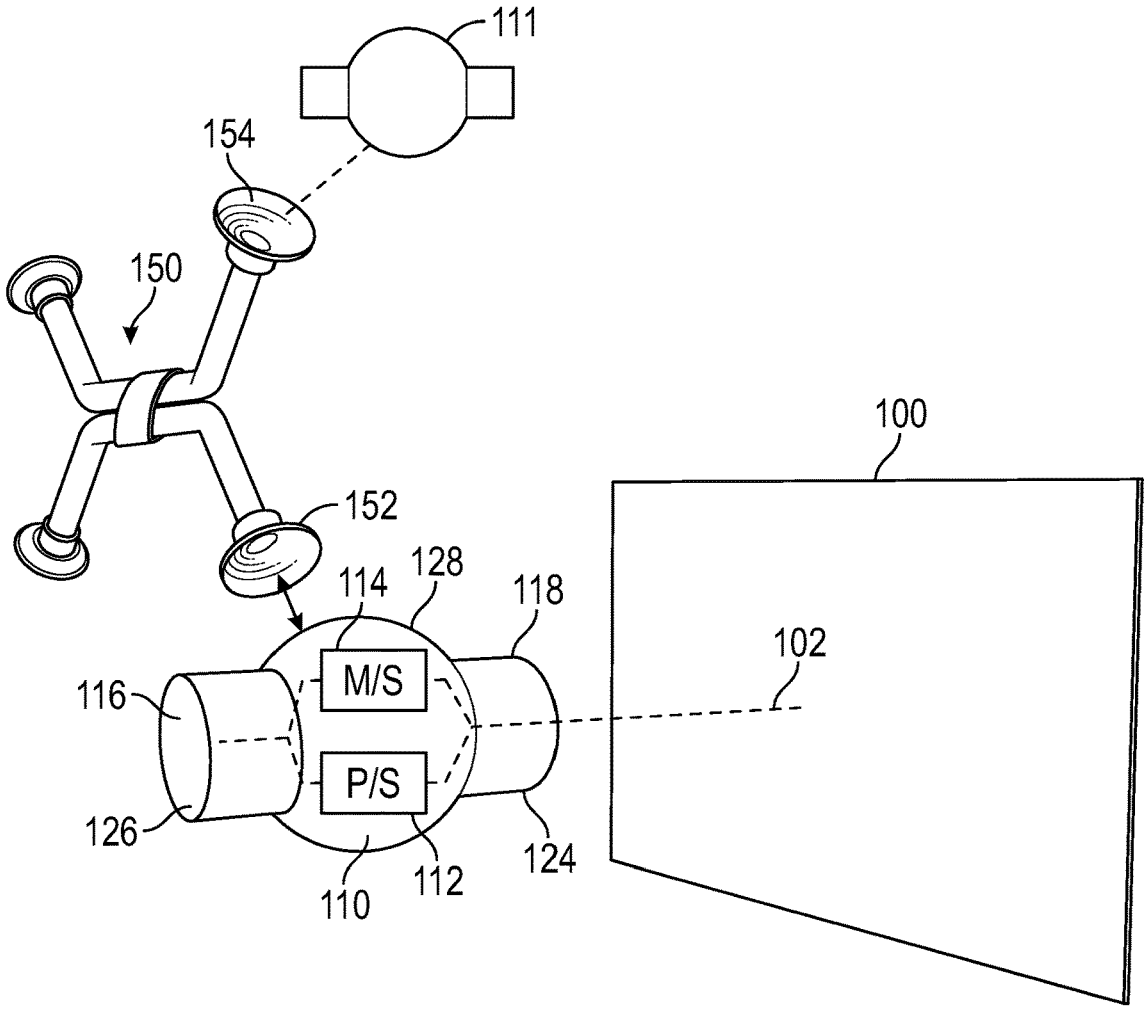
FIG. 1 shows a connection between and LED module, a node, and the node linking structure.

FIG. 1 shows the basic system, where there is an LED panel 100 with a connector 102. The overall wall can be in any shape formed by a number of different LED panels arranged next to each other.

The basic system is shown in FIG. 1, which shows the LED tile 100 connected to a node structure 110, which itself is held by a node linking structure 150. The node is in the shape of two cylinders 124 126, with a rounded ball section 128 in between the two cylinders. One end of the node 118 presses against a corresponding connector 102 on the LED panel. In a similar way, each LED panel can be connected to its own node such as 111.

Each node contains a power supply 112 which receives power and data over cable 116 and also contains a media server 114. The power from the power supply and the information from the media server is connected via the connection between the connector 118 and the connector 102 on the LED panel 100.

The node's rounded body 128 is connected to by a suction cup structure 152 on the node linking structure. The node linking structure is a self-supporting carbon structure having four such suction cups, one at each of four ends, each precisely spaced by the size of the area between different LED structures. As shown, another suction cup device 154 connects to another node 111, which would connect to a different LED panel.

Figure 2:
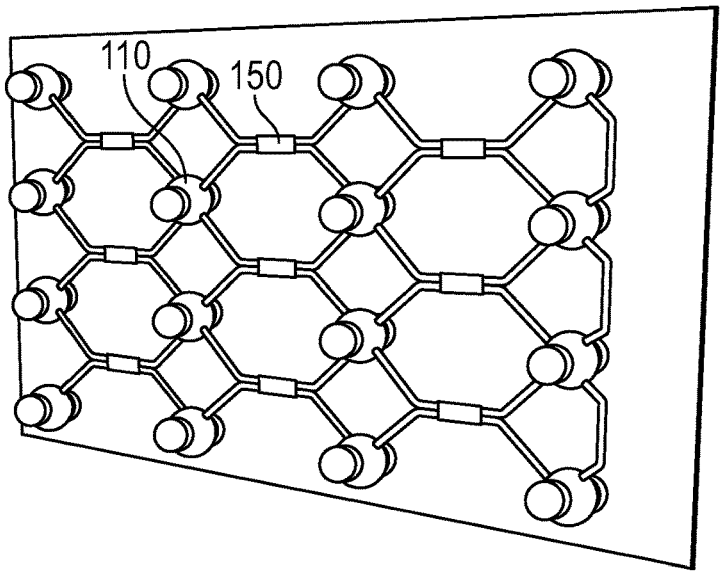
FIG. 2 shows a plurality of nodes connected by node linking structures to LEDs law art LED panels connected in a flat configuration.
Figure 3:
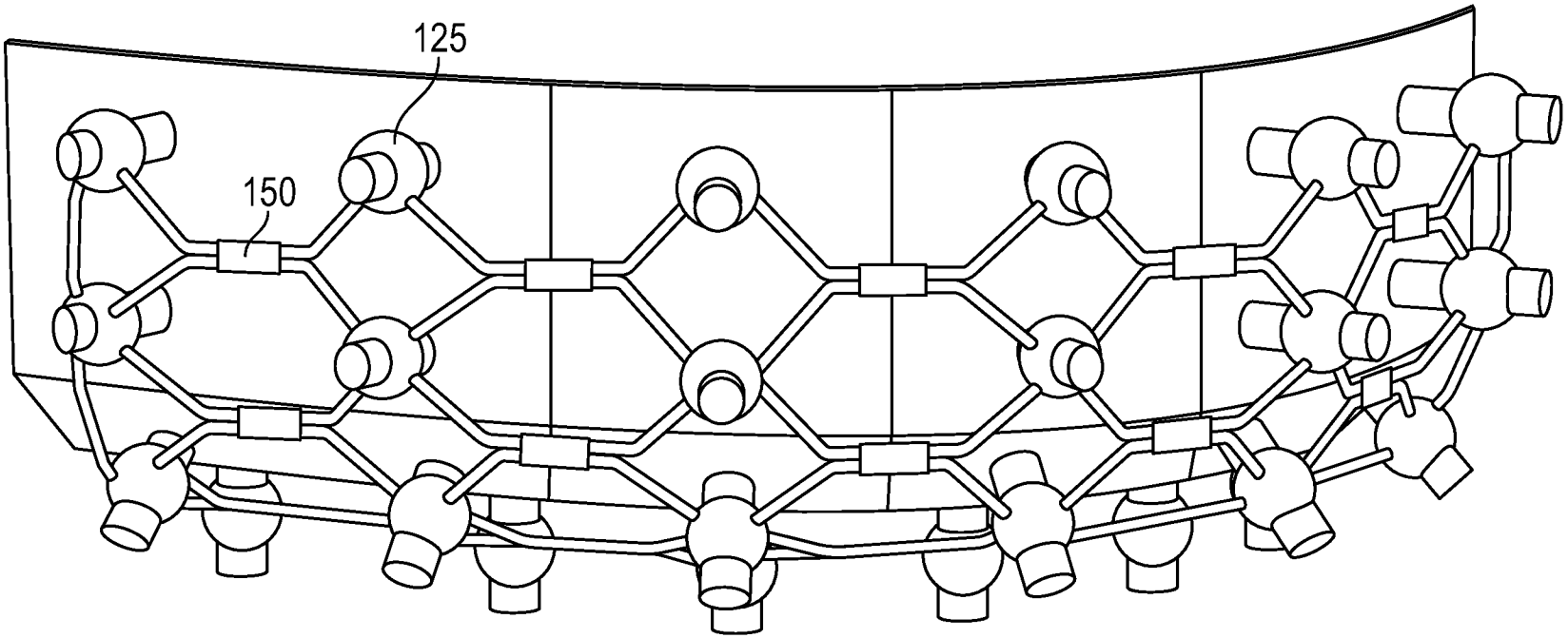
FIG. 3 shows the nodes and node linking modes utilizing the ball joint curving to form a curved panel.

The overall LED wall structure is as shown in FIG. 2 which shows the nodes 110; each node connected to a section of the LED wall structure, held by the node linking structures 150. These enable moving the LED linking structures to any desired position Because the node linking structure is attached on surfaces of the cylindrical shaped section 128 of the node, this enables ball joint curving of the different LED panels relative to one another. As one embodiment, FIG. 3 shows a curved wall, and shows how the node linking structures can attach to different parts on the ball shaped sections 128 of the nodes, to form a curved display. The panels can be connected relative to one another in any desired way.

What is claimed is:

1. A device for connecting multiple modular LED walls, the device comprising:

a plurality of node structures, each node structure having a first end for connecting to one of the LED walls electronically and mechanically, and a central portion connected to the first end side, wherein the central portion forms at least a section of a spherical surface;

a plurality of node linking structures, each node linking structure having four different sphere attaching structures, extending in four different directions, each sphere attaching structure adapted to attach to the spherical surface of one of the plurality of node structures, thereby allowing for varying angles to exist between the plurality of node structures.

2. The device as in claim 1, wherein each node structure includes a power supply therein which provides power to at least one of the LED walls.

3. The device as in claim 2, wherein each node structure includes a media server therein, receiving content, and providing the content to at least one of the LED walls.

4. The device as in claim 1, wherein the node linking structure includes four arms, corresponding to the four sphere attaching structures.

5. The device as in claim 4, wherein the four sphere attaching structures are suction cup structures, the first and second arms of each node linking structure are formed together, and hold the first and second suction cup structures, and third and fourth arms of each node linking structure are formed together and hold the third and fourth suction cup structures, and a connection part connects the first and second arms with the third and fourth arms.

6. The device as in claim 1, wherein the LED wall includes a connector thereon, and the node structure also includes a connector which connects to the connector on the LED wall.

* * * * *